United States Patent [19]

Haller

[11] 4,350,197

[45] Sep. 21, 1982

[54] SHUTTER BLIND ASSEMBLY

[76] Inventor: Berthold Haller, Steinweg 1, 7209 Aldingen, Fed. Rep. of Germany

[21] Appl. No.: 930,506

[22] Filed: Aug. 3, 1978

[51] Int. Cl.[3] ..... E06B 9/26

[52] U.S. Cl. ..... 160/166 A; 160/172; 160/176 R

[58] Field of Search ..... 160/166–178

[56] References Cited

U.S. PATENT DOCUMENTS 3,996,988 12/1976 De Wit ..... 160/176 R 4,103,727 8/1978 Spohr ..... 160/176 R

*Primary Examiner*—Peter M. Caun

[57] ABSTRACT

A shutter blind is disclosed which is comprised of a supporting rail, a plurality of carriages slidably mounted on the supporting rail and a plurality of shutters, each shutter mounted on a respective carriage. A rotating mechanism is provided for rotating the shutters relative to the carriages. The rotating mechanism is comprised of a rotatable rod and a slipable clutch. The slipable clutch, which is interposed between the rotatable rod and the shutters, permits the shutters to be brought into alignment with each other after assembly.

9 Claims, 4 Drawing Figures

SHUTTER BLIND ASSEMBLY

BACKGROUND OF THE INVENTION

1. Field of the Invention

This invention concerns a shutter blind with a laterally movable carriage sliding on rollers in a guide rail for the individual shutters, which are arranged vertically and can be pivoted a limited distance together about their longitudinal axis.

2. Description of the Prior Art

A shutter blind such as this generally has two control devices, a double shutter control cord by means of which the carriages can be displaced laterally and the shutter blind thereby opened and closed, and a rotatable rod serving the purpose of rotating the individual shutters together about their longitudinal axis. This rod may be rotated, for example, by means of a chain which runs around a sprocket provided at one end of the rod.

The traditional shutter blind has various disadvantages. For example, a costly structure is generally required for rotating the individual shutters in the carriages. In addition, maintaining a precise distance between the individual shutters of the closed blind often entails some difficulty. A further difficulty is represented by the fact that the angular position of the shutters is not rigidly fixed; that is, they can be pivoted out of the position in which they are set by even a light touch, so that the individual shutters are in different angular positions and, in the aggregate, present an irregular and unattractive appearance.

Furthermore, the pivoting mechanism for the individual shutters is designed in such a way that the latter can be pivoted only through a relatively limited angle, such as 90° or a maximum of 150°. The aim, nevertheless, is to be able to rotate the shutters axially through 180° in both directions, so that full closing (overlapping of the individual shutters) will be possible in both directions.

Lastly, in the case of the traditional shutter blind where the shutters are generally suspended from the carriage by means of eyes and hooks, the danger always exists that the eyes may break if subjected to an overly high load. In addition, a certain amount of skill is required for introducing the hooks into the eyes.

SUMMARY OF THE INVENTION

An object of the present invention is to provide a shutter blind which does not exhibit the disadvantages referred to in the foregoing.

In particular, a shutter blind is proposed in which rotation of the individual shutters is accomplished in a structurally simple manner, the shutters being suspended from the carriages by a simple arrangement and being fixed in their angular positions so that they are not pivoted from this position when contact is made with them.

These objects are accomplished by means of a shutter blind having the following structure: A rotatable horizontal rod extends through all the carriages, on which the shutters are suspended vertically by means of respective sockets so that the shutter holders, which are connected to the shutters and generally are of plastic, can be easily and rapidly snapped into the carriages. Since such shutter holders can be designed for a maximum load of approximately 27 kg, they are able to cope with all loads which may occur. Lastly, this suspension permits the shutters to be easily replaced by simply pulling the shutter in question out of the respective socket.

The individual carriages have rollers secured on axial pins, the rollers moving along rails mounted on the housing. A horizontal rotating rod, which is provided with a form-locking or force-locking engagement with a driven wheel of a slipping clutch in each individual carriage, extends through all the carriages. The driving wheel of the slipping clutch comprises a worm gear having a horizontally extending longitudinal axis. This worm gear meshes with a vertically arranged sprocket gear. The sprocket is rigidly connected to the upper end of a supporting rod through a socket extending into the interior of the sprocket gear. The lower end of the supporting rod has an opening for introduction of the shutter band.

With this design, the vertical sprockets, and thus the supporting rods connected to the sprockets, may be in any position when the carriages are installed. The angular position of the supporting rods, and thus of the sockets for the shutters, may be ignored when the carriages are installed. After the installation has been completed, the sockets are brought into alignment by setting the rotating rod in an extreme position, for example, by means of a vigorous tug on the chain connected to the rod. All the shutters are thereby set in the same angular position and the coupling is subsequently so firm that the individual shutters can no longer be rotated relative to each other, even in the event of forcible, unintentional contact with them. This ensures that the shutters will, at all times, remain in the angular position in which they have been set.

The individual carriages are connected to each other by means of lamellar spacers which can move freely in slots in the carriages. The ends of the spacers are provided with retaining hooks. The innermost carriage is connected to both ends of a cord which runs over rollers situated at the ends of the rail.

If the shutter blind is to be closed, that is, if the adjacent carriages are to be distributed over the entire width of the shutter blind, first the innermost carriage is displaced along the rail by pulling on the cord until the retaining hook of the spacer moving freely in the next carriage engages this carriage and pulls the latter with it. In this way, all the carriages are engaged in succession and kept at a distance from each other determined by the length of the spacer.

If the shutter blind is to be opened, the innermost carriage is first displaced by pulling on the cord until it strikes against the carriage next to it and carries the latter along with it. The spacers then move freely in the slots in the individual carriages. That is, they do not prevent displacement of the individual carriages. In this way, all the carriages are moved by the one carriage which is pulled along, until finally they all reach their extreme position together.

BRIEF DESCRIPTION OF THE DRAWING

These and other objects and advantages of the invention will become more fully apparent as the following description is read in conjunction with the drawings wherein.

DETAILED DESCRIPTION OF THE PREFERRED EMBODIMENT

Figure 1:
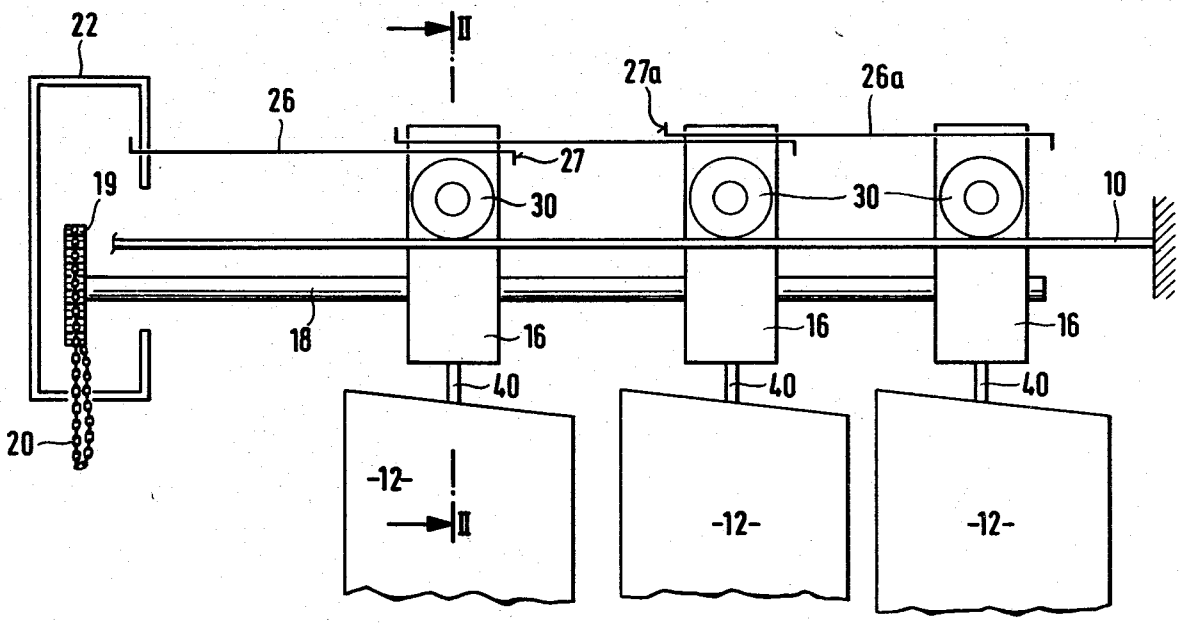
FIG. 1 is a diagrammatic front elevational view of a shutter blind of the preferred embodiment with three carriages and the corresponding control elements.

FIG. 1 illustrates a shutter blind comprised of three shutters 12. These shutters 12 are suspended by way of supporting rods 40 to carriages 16, which can move along a rail 10 by means of rollers 30. Rail 10 is mounted, for example, stationarily to a ceiling or in a housing.

A rotating rod 18, which extends through all of the carriages 16 and engages with them, pivots in an end wall of the rail mounting support 22. The end of rotating rod 18 in the end wall 22 is in the form of a sprocket or is provided with a sprocket 19 over which chain 20 is guided. The rod 18 can be rotated about its longitudinal axis by pulling on chain 20.

The individual carriages 16 are connected to each other by means of spacers 26 which are of spring steel strips and can be displaced in slots in the carriages. As seen in FIG. 1, the ends of the spacers 26 are in the form of retaining hooks 27. The retaining hooks 27 are curved in such a way that they can engage with the carriages 16.

The mode of operation of a shutter blind such as this is to be described concisely in the following text. It is assumed that all carriages 16 with the respective shutters 12 are close together on the left side as shown in FIG. 1, that is, that the blind is open. If the upper right carriage is pulled, this carriage, as shown in FIG. 1, is drawn to the right and takes its spacer **26*a* along with it. When this spacer 26*a* has been fully drawn out, its retaining hook 27*a* engages with the second carriage and carries the latter with it. In this way, all carriages 16 are finally moved to the right and are separated by distances determined by the effective length of spacers 26**.

In general, these spacers have a width of 80 to 160 mm, and preferably 127 mm.

As a result of pulling on the chain 20, the rotating rod 18 is rotated about its longitudinal axis, whereby shutters 12 in carriages are pivoted about their longitudinal axis by a mechanism illustrated in FIG. 2 to be described hereinbelow.

The pivoting of the shutters and the displacement of the carriages in the rail occur separately.

The shutters can be pivoted through a total angle of 180° so that complete overlapping on both sides of the shutters is possible. Full overlapping on only one side has been possible with the previously known systems.

The control mechanism for the pivoting of the shutters will now be described with reference being made to FIG. 2.

Carriages 16 ride on rail 10 by means of rollers 30 mounted on axial pins 32. The components of carriage 16 are preferably constructed of plastic.

A shutter holder or shutter band 34 is mounted at the upper edge of shutter 12 which is of a relatively rigid laminar material. In its central area, shutter band 34 has a short, projection 36 which thickens to form a head **36*a*. The head 36*a* is connected by way of a socket indicated diagrammatically at 38 with a supporting rod 40 of carriage 16. The lower end of supporting rod 40 has an initially narrow slot 42 with parallel walls, the slot widening at the upper end to form a larger recess 44, so that head 36*a* may be introduced through slot 42 and kept form-locked in recess 44**.

A locking and adjusting head 46 is conveniently provided in the center of projection 36 of shutter band 34. It can be introduced into a corresponding through opening 48 on the lower end of supporting rod 40 (See FIGS. 2 and 3) in order to facilitate accurate central insertion of the shutter holder into socket 38.

Supporting rod 40 is mounted rotatably in carriage 16, so that the shutter holder and thus shutter 12 are pivoted about their longitudinal axis when supporting rod 40 is rotated.

Figure 2:
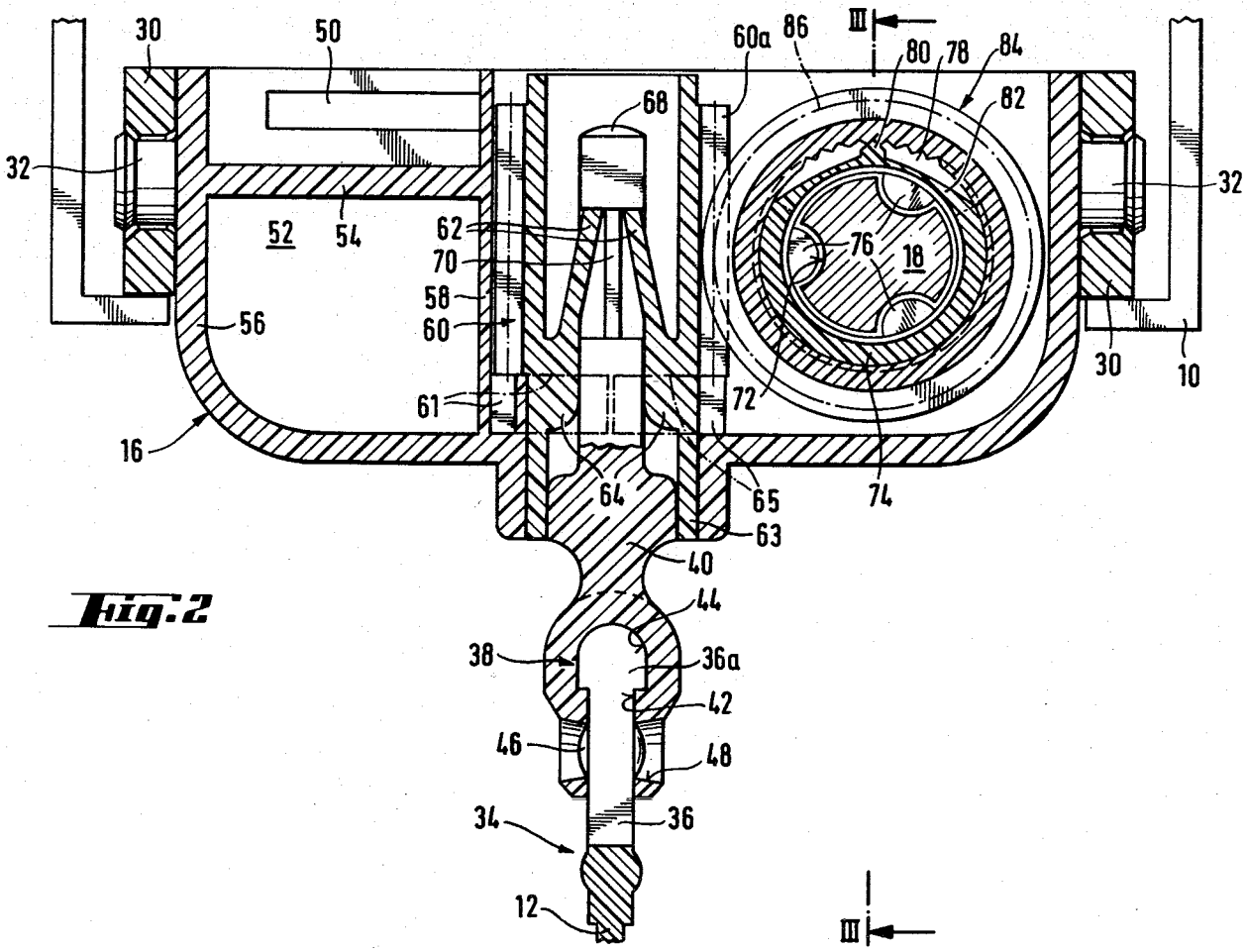
FIG. 2 is a vertical cross-section taken along the line II—II of FIG. 1 illustrating the rail with a carriage.
Figure 3:
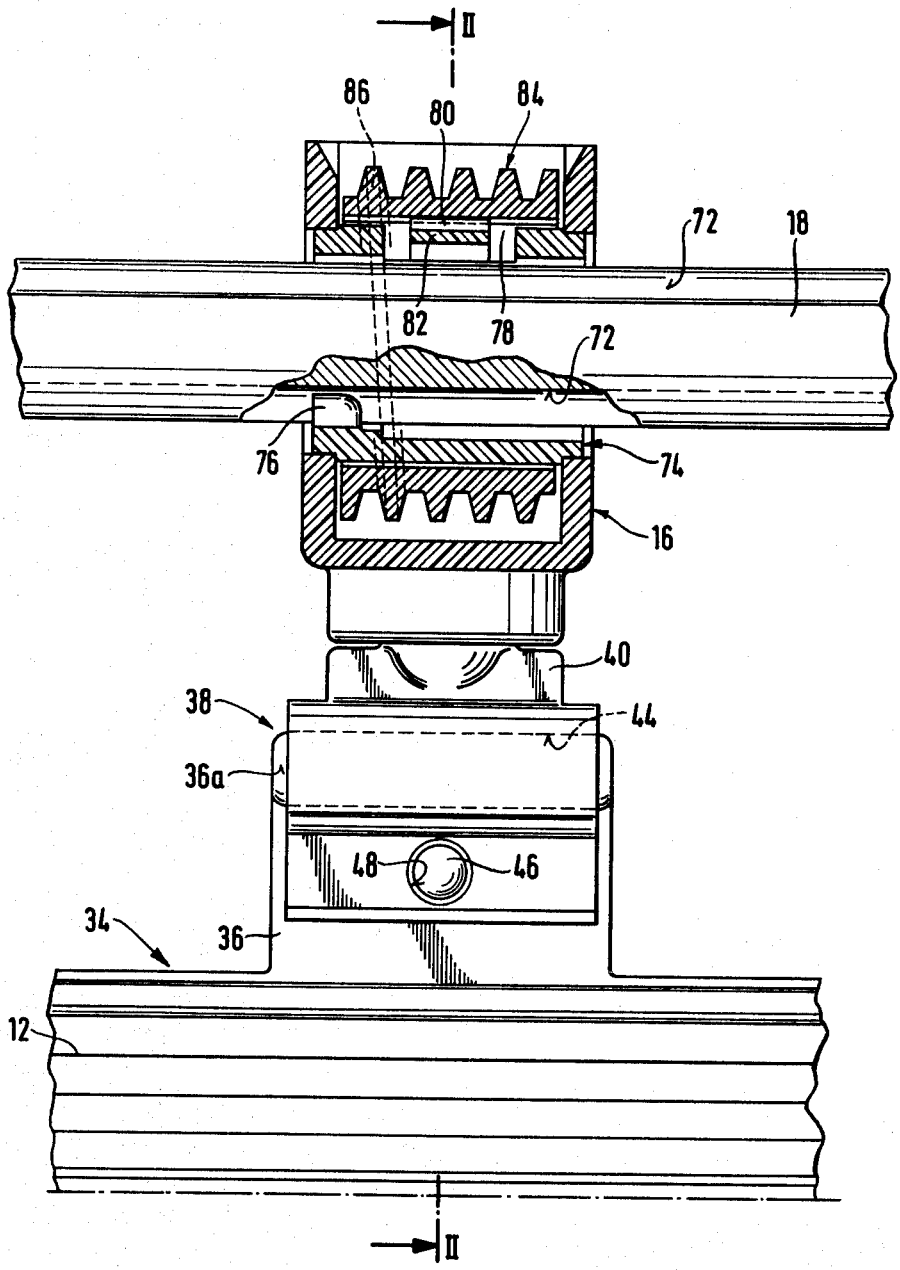
FIG. 3 is a vertical cross-section taken along the line III—III of FIG. 2 illustrating one carriage with a shutter.

On the left side of carriage 16, as shown in FIG. 2, there are provided both a slot 50 which receives the previously described spacers 26 and in which the latter may be moved, and a through opening 52 through which a draw cord runs.

Between slot 50 and opening 52 there is an approximately horizontal through wall 54 extending from the left outer wall 56 of the carriage approximately to the center of a vertical through wall 58.

This wall 58 has a semicircular cross-section so that a vertical, almost tubular cavity is formed, in which a sprocket 60 is mounted so that its longitudinal axis runs vertically.

Figure 4:
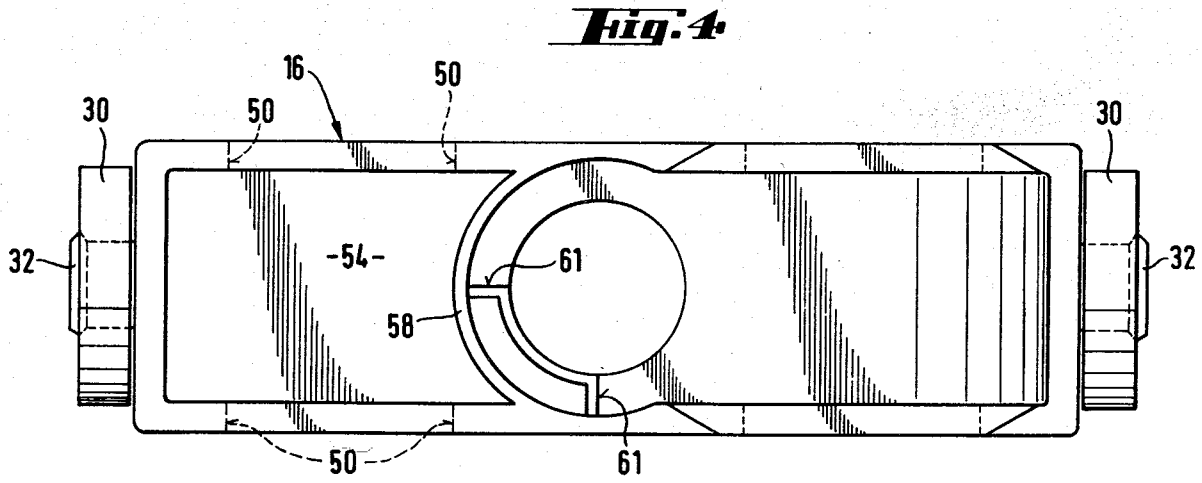
FIG. 4 is a plan view of the carriage without the sprocket and the worm gear.

On the floor of this hollow space, a boss 61 has been mounted, which occupies a quarter of the total floor surface (See FIG. 4). The sprocket 60 is equipped with biased teeth **60*a*. The sprocket 60 is hollow internally, and ends in the lower part in a cylinder-shaped, hollow tappet 63. At the upper end of the tappet 63, there is a boss 65**, which extends over a quarter of the surface area of the tappet.

Sprocket 60 is hollow and has on its cylindrical inner wall two opposed projections 64 extending upwardly to form two movable lips 62. The lips are inclined toward each other. Supporting rod 40 is inserted into the interior of sprocket 60 until an annular head 68 of supporting rod 40 is situated above lips 62 and the supporting rod is thus locked in position. Head 68 is connected with the body proper of supporting rod 40 by way of a narrow neck 70.

Supporting rod 40 is thus engaged with sprocket 60 at several places and areas so that, when sprocket 60 is rotated, the supporting rod is rotated along with it.

The connection between sprocket 60 and supporting rod 40 can, if necessary, be further secured by means of a form-locking or force-locking engagement.

As is to be seen from FIG. 2, rotating rod 18, which is generally of metal and is in its longitudinal direction provided with round recesses 72 in the form of grooves, extends through the right side of carriage 16. A hollow cylinder 74, whose length in the longitudinal direction of rotating rod 18 approximately equals the width of carriage 16, is mounted on rotating rod 18. In its interior, hollow cylinder 74 has small, round projections 76 which fit into recesses 72 (see FIG. 3).

As seen in FIG. 2, three recesses 72 are provided on rotating rod 18 and three projections 76 corresponding to these recesses are provided on the hollow cylinder 74. The invention is not, however, restricted to the use of three recesses or projections.

While hollow cylinder 74 is tubular in shape in its longitudinal end areas, its exterior is somewhat recessed in the central area, as is illustrated at 78. Hence, the exterior of hollow cylinder 74 is, in this area, somewhat inside the exterior describing the remainder of the tubular shape.

As is indicated in FIG. 2, this area of hollow cylinder 74 is formed in the following manner: hollow cylinder 74 is provided with a slotshaped recess in the direction of curvature of its surface, which recess is bridged over by a narrow strip 82 with free edges. A toothshaped projection 80 is formed on the exterior of this strip 82.

Since this projection 80 is situated on relatively thin, and deformable, strip 82, projection 80 can be displaced somewhat in the radial direction of hollow cylinder 74.

Hollow cylinder 74 is surrounded by a hollow worm gear 84 whose interior is of a diameter such that projection 80 of hollow cylinder 74 fits against it. In addition, the interior of worm gear 84 is shaped in such a way that a force-locking engagement or a form-lock results between projection 80 and worm gear 84. The interior of worm gear 84 may be provided with a groove for this purpose, as is indicated in FIG. 2.

Alternatively, the interior of worm gear 84 may be provided with a configuration such that a friction lock results.

Worm gear 84 is provided on its exterior with several spirals 86 which engage with the outer teeth of vertically mounted sprocket 60.

As the chain 20, shown in FIG. 1, is pulled, it causes rod 18 to rotate. As rod 18 rotates, hollow cylinder 74 is rotated along with it, since its projections 76 are engaged with recesses 72 or rotating rod 18; that is, a form-lock exists between hollow cylinder 74 and rotating rod 18.

As hollow cylinder 74 rotates with rotating rod 18, its projection 80 is engaged by friction-lock with the interior of worm gear 84, so that worm gear 84 is also rotated. As the horizontally mounted worm gear 84 is rotated, vertically mounted sprocket 60, and thus supporting rod 40, are rotated along with it; that is, shutters 12 are pivoted about their longitudinal axis.

As a result of this pivoting mechanism configuration, shutters 12 can be rotated axially through 90° on each side, for a total of 180° so that complete overlapping, that is, completed blind closing to both sides, is possible.

The rotation of the shutters 12 around their axis, by not more than 90° on each side is secured by the boss 61 on the floor of the carriage and the boss 65 on the tappet 63 of the sprocket 60. The boss 65 of the vertical sprocket 60, in the final position of the shutters, meets boss 61 of the floor of the carriage. In this position the curtain is closed.

Use of the slipping engagement between rotating rod 18 and worm gear 84 has the following additional advantage: adjustment of supporting rods 40 and thus of shutters 12 at specific angles is not required when the carriages are mounted. After the mounting has been completed, the supporting rods 40 and thus sockets 38 are adjusted by means of a vigorous pull on chain 20 since, as a result of this pull, projections 80 of hollow cylinders 74 slip over the interior of worm gears 84 and are all brought into the same final position. The slipping engagement, that is, the friction lock between projection 80 and the interior of worm gear 84 is sufficiently firm so that individual shutters 12 cannot be turned out of position unintentionally when contact is made with them.

This installation procedure is much simpler than the traditional procedure in which the supporting rods must have already been adjusted at the time of the installation, that is, care must be taken during installation to make certain that the shutters occupy the same angular position relative to each other.

The present invention may be embodied in other specific forms without departing from the spirit or essential characteristics thereof. The presently disclosed embodiments are, therefore, to be considered in all respects as illustrative and not restrictive, the scope of the invention being indicated by the appended claims rather than the foregoing description, and all changes which come within the meaning and range of equivalency of the claims are, therefore, to be embraced therein.

What is claimed:

1. A shutter blind comprising:

a supporting rail means;

a plurality of carriages slidably mounted on said supporting rail means;

rotating means within a respective one of said carriages, a respective one of said rotating means comprising a rotatable rod having recesses on its outer surface, a hollow cylinder surrounding said rod, said hollow cylinder being provided with a friction-locking means on its outer surface, a keying means comprising a form-lock mating interconnection between said rotatable rod and said hollow cylinder, a worn gear surrounding said hollow cylinder and interconnected to said hollow cylinder by means of said friction-locking means;

a plurality of sprocket gears, each sprocket gear drivingly interconnected with a respective one of said worm gears;

a plurality of supporting rods, each supporting rod interconnected with a respective one of said sprockets;

a plurality of shutters, each shutter being mounted on a respective one of said supporting rods.

2. A shutter blind as claimed in claim 1 wherein said keying means comprises at least one longitudinally extending recess in said rotatable rod and at least one cooperating mating radially inwardly extending projection on the interior of said hollow cylinder.

3. A shutter blind as claimed in claim 1 wherein said friction-locking means comprises a resilient projection on the outer surface of said hollow cylinder and said worm gear is hollow and has a plurality of recesses on its interior surface, said resilient projection engaging one of said recesses.

4. A shutter blind as claimed in claim 1 wherein said friction-locking means comprises a strip forming a bridge across a recess in the wall of said hollow cylinder.

5. A shutter blind as claimed in claim 1 wherein the sprocket is equipped in the lower part with a cylinder-shaped tappet, said tappet is equipped with a boss in one of the both possible final positions of the shutter meeting the boss of the floor of the carriage.

6. A shutter blind as claimed in claim 5 wherein each carriage is provided with a slot, a spacer is provided slidably receiving said slots of adjacent pairs of carriages, said spacers having hooked retaining ends limiting displacement distance between said adjacent pairs of carriages as said carriages slide along said supporting rail means.

7. A shutter blind as claimed in claim 6 wherein said spacers are formed of lengths of spring steel.

8. A shutter blind as claimed in claim 1 wherein each said supporting rod includes a socket and each said shutter band has a projection, said projection being engaged in said socket.

9. A shutter blind as claimed in claim 8 wherein said socket includes an opening adapted to receive a locking head means for locking and adjusting each said shutter band.

* * * * *